US006127785A

United States Patent [19]

Williams

[11] Patent Number: 6,127,785

[45] **Date of Patent: *Oct. 3, 2000**

[54] FLUORESCENT LAMP POWER SUPPLY AND CONTROL CIRCUIT FOR WIDE RANGE OPERATION

[75] Inventor: James M. Williams, Palo Alto, Calif.

[73] Assignee: Linear Technology Corporation, Milpitas, Calif.

[ * ] Notice: This patent is subject to a terminal disclaimer.

[21] Appl. No.: 08/757,995

[22] Filed: Nov. 27, 1996

Related U.S. Application Data

[63] Continuation of application No. 08/213,865, Mar. 16, 1994, abandoned, which is a continuation-in-part of application No. 08/043,152, Mar. 31, 1993, Pat. No. 5,408,162, which is a continuation of application No. 07/857,734, Mar. 26, 1992, abandoned.

[51] Int. Cl.[7] ..... H05B 37/02

[52] U.S. Cl. ..... 315/224; 315/307; 315/DIG. 5

[58] Field of Search ..... 315/307, 209 R, 315/276, 279, DIG. 5, 219, 206, 224

[56] References Cited

U.S. PATENT DOCUMENTS

| | | | |
|---|---|---|---|
| 4,277,728 | 7/1981 | Stevens | 315/307 |
| 4,344,122 | 8/1982 | Jones | 363/23 |
| 4,723,098 | 2/1988 | Grubbs | 315/306 |
| 4,905,136 | 2/1990 | Tanaka | 363/124 |
| 4,920,302 | 4/1990 | Konopka | 315/307 |
| 4,952,849 | 8/1990 | Fellows et al. | 315/307 |
| 5,001,386 | 3/1991 | Sullivan et al. | 315/219 |
| 5,068,576 | 11/1991 | Hu et al. | 315/291 |
| 5,111,118 | 5/1992 | Fellows et al. | 315/307 |

OTHER PUBLICATIONS

"*RCA Designer's Handbook: Solid–State Power Circuits,*" Technical Series SP–52, pp. 300–338 and 409–429, published by RCA Corporation, Somerville, New Jersey in 1971.

"*1992 Catalog of Sumida Electric Co., Ltd.,*" pp. 1–5 and 25, published by Sumida Electric Co., Ltd., Japan in 1991.

"*Linear Technology Application Note 45,*" pp. AN45–1, AN45–21 to AN45–22, published by Linear Technology Corporation, Milpitas CA in Jun. 1991.

"*Linear Technology Application Note 49,*" pp. AN49–1 to AN49–16, published by Linear Technology Corporation, Milpitas CA in Aug. 1992.

(List continued on next page.)

*Primary Examiner*—David Vu
*Attorney, Agent, or Firm*—Fish & Neave; Robert W. Morris

[57] ABSTRACT

A power supply and control circuit is provided for driving a fluorescent lamp from a low voltage DC power source such as a battery. A DC-to-AC inverter coupled to a switching regulator converts low DC voltage into a higher AC voltage for driving the fluorescent lamp. In one embodiment, the lamp is included in a feedback loop which includes a circuit for producing a feedback signal indicative of the magnitude of current conducted by the lamp. In another embodiment, the lamp is symmetrically driven by isolating the lamp from the driving circuitry and indirectly deriving the feedback signal. The feedback signal is applied to the switching regulator to produce in the lamp a regulated current and, hence, a regulated lamp intensity. The magnitude of the lamp current can be adjusted to enable the intensity of the fluorescent lamp to be smoothly and continuously varied (without "dead-spots" or "pop-on") over a chosen intensity range, including if desired, from substantially full OFF to full ON. When the lamp is symmetrically driven, the lamp is illuminated in a more uniform manner long the entire length of the tube. A method for driving a fluorescent lamp from low voltage DC power source is also provided.

51 Claims, 12 Drawing Sheets

OTHER PUBLICATIONS

Williams, Jim, "*Designing supplies for powering LCD backlighting,*" published in *EDN,* pp. 125–130, 132, 134 and 136, Oct. 29, 1992.

"*Linear Technology Application Note 55,*" pp. 1–43, published by Linear Technology Corporation, Milpitas CA in Aug. 1993.

Williams, Jim, "LCD–Hinterleuchtung mit hohem Wirkungsgrad," *Elektronik,* vol. 42, No. 4, pp. pp 82–84, Feb. 23, 1993.

Williams, Jim, "*Techniques illuminate backlit LCDs with high efficiency,*" published in *EDN,* pp. 89, 90 and 94, Jan. 6, 1994.

Schematic diagram of a fluorescent lamp control circuit of the Sanyo MBC–17NB Series Small Business Computer.

FLUORESCENT LAMP POWER SUPPLY AND CONTROL CIRCUIT FOR WIDE RANGE OPERATION

CROSS REFERENCE TO RELATED APPLICATIONS

This is a continuation of application Ser. No. 08/213,865, filed Mar. 16, 1994, now abandoned, which was a continuation-in-part of application Ser. No. 08/043,152, filed Mar. 31, 1993, now U.S. Pat. No. 5,408,162, which was a file-wrapper continuation of application Ser. No. 07/857,734, filed Mar. 26, 1992, now abandoned.

BACKGROUND OF THE INVENTION

This invention relates to fluorescent lamp power supplies. More particularly, this invention relates to a fluorescent lamp power supply and control circuit which enables the lamp to be regulated to shine at a substantially constant intensity as the lamp ages or the power supply voltage fluctuates, and which also enables lamp intensity to be adjusted continuously and smoothly over a chosen intensity range including, if desired, substantially from full OFF to full ON.

Fluorescent lamps are finding increased use in systems requiring an efficient and broad-area source of visible light. For example, portable computers such as lap-top and notebook computers use fluorescent lamps to back-light or side-light liquid crystal displays to improve the contrast or brightness of the display. Fluorescent lamps have also been used to illuminate automobile dashboards, and are being considered for use with battery-driven backup emergency EXIT lighting systems in commercial buildings.

Fluorescent lamps find use in these and other low-voltage applications because they are more efficient, and emit light over a broader area, than incandescent lamps. Particularly in applications requiring long battery life, such as in the case of portable computers, the increased efficiency of fluorescent lamps translates into extended battery life or reduced battery weight, or both.

In low-voltage applications such as those discussed above, a power supply and control circuit must be used to operate the fluorescent lamp. This is because power typically is provided by a 3–20 volt DC source, while fluorescent lamps generally require 100 volts AC or more to efficiently operate. Accordingly, a power supply and control circuit is needed to convert the available low DC voltage into the necessary high AC voltage.

Previous known fluorescent lamp power supply and control circuits have suffered from one or more drawbacks. Some circuits, for example, cannot smoothly and continuously vary the intensity of a fluorescent lamp from substantially full OFF to full ON. These circuits have low intensity "dead-spots" which cause the fluorescent lamp to either abruptly and prematurely turn OFF when the lamp's intensity is reduced toward zero, or to abruptly "pop-on" when the intensity is increased from zero. Other known circuits avoid this problem simply by limiting the range over which the lamp's intensity can be varied. These circuits do not allow adjustment of intensity over the range of full OFF to full ON.

A further disadvantage of some previous known fluorescent lamp power supply and control circuits is that lamp intensity may change as the lamp ages or as the power supply voltage fluctuates.

Yet another disadvantage of some previous known fluorescent lamp power supply and control circuits is that they are inefficient. This inefficiency necessitates the use of larger and heavier batteries or results in decreased battery life. Neither is desirable in portable computer applications.

A further disadvantage of some known fluorescent lamp power supply and control circuits is that they can be a source of radio frequency emission. Such emission can cause undesirable electromagnetic interference with nearby devices, and can degrade overall circuit efficiency.

An additional disadvantage of some known fluorescent lamp power supply and control circuits is that at relatively low intensity levels, low excitation voltages and currents associated with the fluorescent lamp can result in an electromagnetic field that is non-uniformly distributed along the length of the fluorescent tube. Consequently, the light output degrades along the length of the tube, typically with incomplete or no visible output at the low voltage end of the tube. Previous known circuits that address non-uniform light distribution typically include voltage mode regulation circuitry floating from the lamp. Unfortunatly, the voltage mode regulation causes the range of dimming to be limited, and thus, the lamps have narrow operating ranges.

In view of the foregoing, it would therefore be desireable to provide a power supply and control circuit for a fluorescent lamp which enables the lamp's intensity to be regulated so that it shines at a substantially constant intensity as the lamp ages or as the power supply voltage fluctuates.

It would also be desirable to provide a power supply and control circuit for a fluorescent lamp which enables the lamp's intensity to be continuously and smoothly adjusted by a user over a chosen range of intensities.

It would further be desirable to provide a power supply and control circuit for a fluorescent lamp which enables the lamp's intensity to be continuously and smoothly adjusted by a user from substantially full OFF to full ON.

It would additionally be desirable to be able to provide such a fluorescent lamp power supply and control circuit which is efficient, and which produces a minimum of spurious radio frequency emissions.

It would still further be desirable to provide a fluorescent lamp power supply and control circuit which enables the lamp to generate light output which is uniformly distributed throughout the length of the fluorescent tube for a wide range of operating parameters.

SUMMARY OF THE INVENTION

It is an object of this invention to provide a fluorescent lamp power supply and control circuit which enables the intensity of the lamp to be regulated so that the lamp shines at a substantially constant intensity as the lamp ages or as the power supply voltage fluctuates.

It is also an object of this invention to provide a fluorescent lamp power supply and control circuit which enables the intensity of the lamp to be adjusted continuously and smoothly over a chosen range of intensities.

It is a further object of this invention to provide a fluorescent lamp power supply and control circuit which enables the intensity of the lamp to be adjusted continuously and smoothly substantially from full OFF to full ON.

It is an additional object of this invention to provide such a fluorescent lamp power supply and control circuit which is efficient so as to reduce power supply requirements and also extend battery lifetime.

It is yet an additional object of this invention to provide such a fluorescent lamp power supply and control circuit which emits a minimum of radio frequency interference.

It is still another object of this invention to provide a fluorescent lamp power supply and control circuit which enables the lamp to generate light output which is uniformly distributed throughout the length of the fluorescent tube for a wide range of operating parameters.

In accordance with the present invention, there is provided a power supply and control circuit and method for driving a fluorescent lamp from a low voltage D.C. source. A regulator circuit, powered by the D.C. source, is coupled to a DC-to-AC inverter the output of which, in turn, is coupled to a first terminal of the lamp. The inverter converts, under control of the regulator circuit, the low-voltage DC supplied by the input DC power source to high-voltage sinusoidal AC sufficient to operate the fluorescent lamp.

In one embodiment, a second terminal of the lamp is coupled to a circuit which senses and produces a signal indicative of the magnitude of current conducted by the lamp. This current sense signal is fed back to the regulator in such manner so as to regulate the current supplied to the lamp by the inverter. As a result, the current conducted by the lamp—and, hence, the intensity of the light emitted by the lamp—are regulated as a function of the feedback signal.

In another embodiment, and in accordance with another aspect of the invention, the terminals of the fluorescent lamp may be coupled across the terminals of the transformer's AC output such that the lamp fully floats without any direct connection to the driving circuitry. The output of the fluorescent lamp is indirectly regulated by circuitry which monitors the lamp's drive power. As a result, asymmetries in the lamp's drive are reduced to cause a more uniform distribution of energy and light output across the length of the lamp.

A means is a provided in both embodiments to enable the lamp's drive current to be varied by a user, thus allowing lamp intensity to be smoothly and continuously adjusted (without dead-spots or pop on) over a chosen range of intensities. This range of intensity variation can include, if desired, from substantially full OFF to full ON.

The combination of a switching regulator and an inverter for producing substantially sinusoidal AC results in a highly efficient circuit which emits a minimum of spurious RF radiation. In addition, floating the lamp without direct electrical connection to the driving circuitry and indirect monitoring of the feedback signal result in a more uniformly distributed electrical field, and enhances uniformity of the light emitted from the fluorescent lamp.

BRIEF DESCRIPTION OF THE DRAWINGS

The above and other objects and advantages of the present invention will be apparent upon consideration of the following detailed description, taken in conjunction with accompanying drawings, in which like reference characters refer to like parts throughout, and in which.

DETAILED DESCRIPTION OF THE INVENTION

Figure 1:
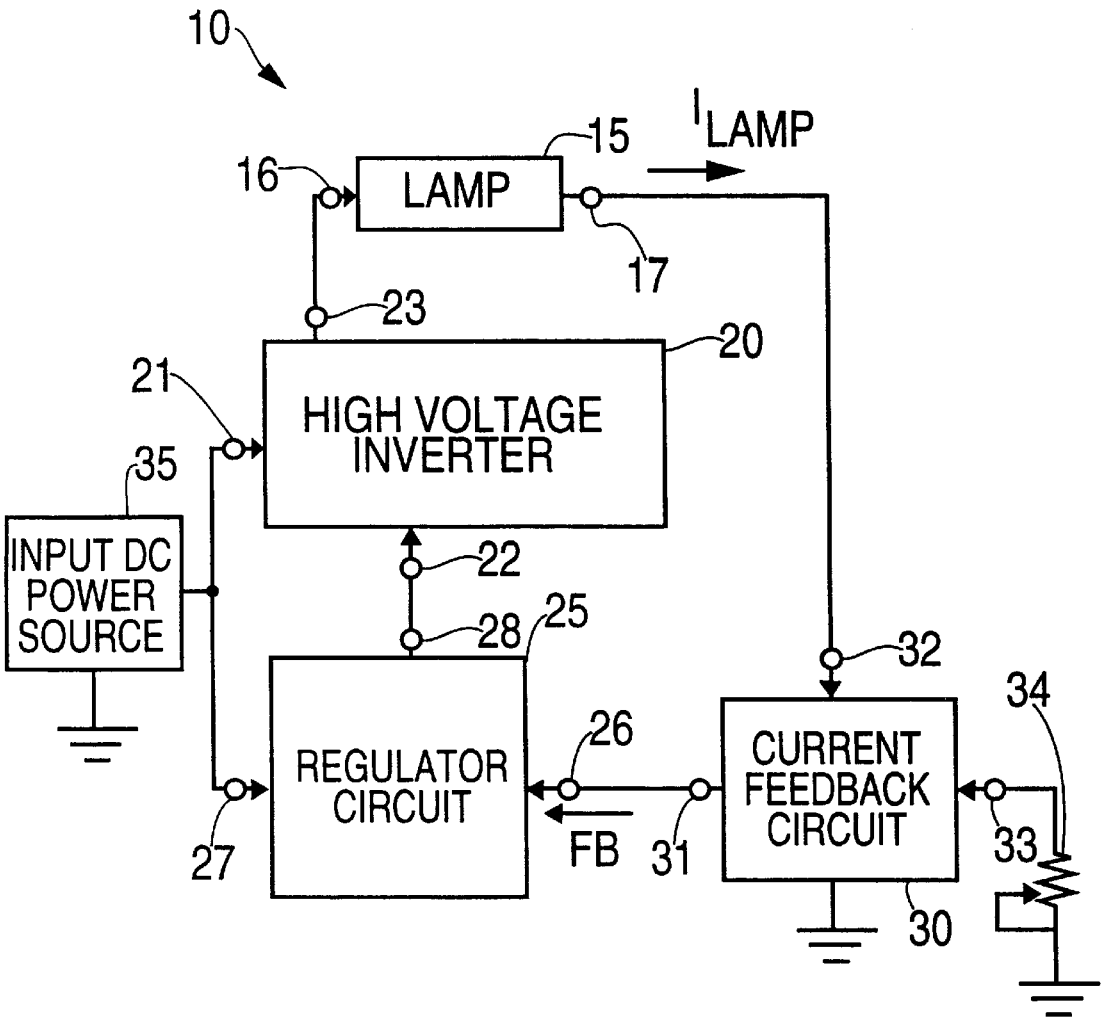
FIG. 1 is a block diagram of the fluorescent lamp power supply and control circuit of the present invention.

FIG. 1 is a block diagram of the fluorescent lamp power supply and control circuit of the present invention.

As shown in FIG. 1, input DC power source 35 provides power for the circuit. Power source 35 can be any source of DC power. For example, in the case of a portable computer such as a lap-top or notebook computer, power source 35 can be a nickel-cadmium or nickel-hydride battery providing 3–5 volts. Or, if the circuit of the present invention is used with an automobile dashboard, power source 35 can be a 12–14 volt automobile battery and power supply. Similarly, fluorescent lamp 15 can be any type of fluorescent lamp. For example, in the case of lighting a display in a portable computer, fluorescent lamp 15 can be a cold- or hot-cathode fluorescent lamp.

Input DC power source 35 supplies low DC voltage to regulator circuit 25 (at terminal 27) and high-voltage inverter 20 (at terminal 21). Regulator circuit 25 can be a linear or switching regulator but, for maximum efficiency, a switching regulator is preferred. The output of regulator circuit 25 is taken from terminal 28. Terminal 26 is a feedback terminal adapted to receive a feedback signal by which the output of regulator 25 can be controlled. If regulator 25 is a switching regulator, the feedback terminal causes the duty cycle of the regulator's switching transistor to be controlled to regulate the output.

High-voltage inverter 20 receives a low voltage DC input at terminal 21 from input DC power source 35, and produces at output terminal 23 an AC voltage sufficient in magnitude to drive fluorescent lamp 15. Typically, the AC voltage produced by inverter circuit 20 is 100 volts or more. Terminal 22 is a control terminal coupled to receive from terminal 28 of regulator circuit 25 a control signal. The control signal regulates the output of high-voltage inverter 20, in a manner as described below. The output of inverter 20 is coupled to lamp 15 at the lamp's terminal 16 (typically, through a conventional ballast capacitor not shown). For maximum efficiency of operation, and to minimize the emission of radio frequency interference, inverter circuit 20 preferably converts DC power to sinusoidal AC power.

Also in FIG. 1 is a current feedback circuit 30, shown coupled at terminal 32 to terminal 17 of lamp 15. Feedback circuit 30 functions to produce, at terminal 31, a feedback signal FB indicative of the magnitude of current $I_{LAMP}$ conducted by fluorescent lamp 15. Many different types of current feedback circuits can be used for circuit 30. Preferably, however, circuit 30 includes a current sense impedance coupled between terminal 32 and ground, with signal FB at terminal 31 being a voltage developed across that impedance which is proportional to the magnitude of $I_{LAMP}$. Also coupled between terminal 33 of current feedback circuit 30 and ground is a variable resistor 34. As discussed below, variable resistor 34 can be used to adjust the magnitude of feedback signal FB and, hence, the loop gain of the circuit. As a result, the intensity of fluorescent lamp 15 can be adjusted with control 34 smoothly and continuously (without dead-spots or pop-on) throughout a chosen range of intensities, including if desired, from substantially full OFF to full ON.

The circuit of FIG. 1 operates as follows. High voltage inverter 20, in combination with regulator circuit 25, delivers high voltage AC power to fluorescent lamp 15. The current through fluorescent lamp 15, $I_{LAMP}$, is sensed by current feedback circuit 30. Circuit 30 produces a feedback signal FB proportional to the magnitude of $I_{LAMP}$. By coupling signal FB back to a feedback terminal of regulator circuit 25, the output of regulator circuit 25 is modulated as a function of the magnitude of $I_{LAMP}$. The output of regulator circuit 25, in turn, controls and modulates the output of inverter 20. As a result, the magnitude of current ($I_{LAMP}$) conducted by fluorescent lamp 15—and, hence, the intensity of light emitted by the lamp—is regulated to a substantially constant value.

By including lamp 15 in a current feedback loop with regulator 25, the lamp's current and light intensity will be regulated and thus will remain substantially constant despite changes in input power, lamp characteristics or environmental factors. Circuit 10 functions to keep the lamp current $I_{LAMP}$ substantially constant, independent of lamp impedance or power supply voltage. Thus, as a lamp's impedance goes up or down as the lamp ages, circuit 10 adjusts to such change as appropriate so as to maintain a regulated constant current and lamp intensity, even though the lamp ages. Circuit 10 similarly adjusts as the power supply voltage fluctuates. These features of the present invention can therefore extend the useful lifetime of a fluorescent lamp in some applications.

The operating current of lamp 15 (and, hence, the intensity of the lamp) can be adjustably controlled by adjusting the feedback gain via variable resistor 34. By varying resistance 34, the magnitude of feedback signal FB applied to regulator 25 is varied. This causes lamp current $I_{LAMP}$ to vary responsively. Because fluorescent lamps have high impedance and are essentially current-driven devices, varying the magnitude of $I_{LAMP}$ results in variation of the lamp 15's intensity. Because it is lamp current that is being directly controlled, variable resistor 34 produces a smooth and continuous adjustment of lamp intensity throughout a chosen range of intensity adjustment, including if desired, from full OFF to full ON, without dead-spots or pop-on.

It will, of course, be appreciated by those skilled in the art that variable resistor 34 is shown for purposes of illustration, and not limitation. Other circuit techniques and configurations could as well be used to provide variable control of the lamp current. For example, similar lamp intensity control action could as well be obtained by adding a signal (not shown) at the feedback point (terminal 26 of regulator circuit 25) to adjust loop gain.

Figure 2:
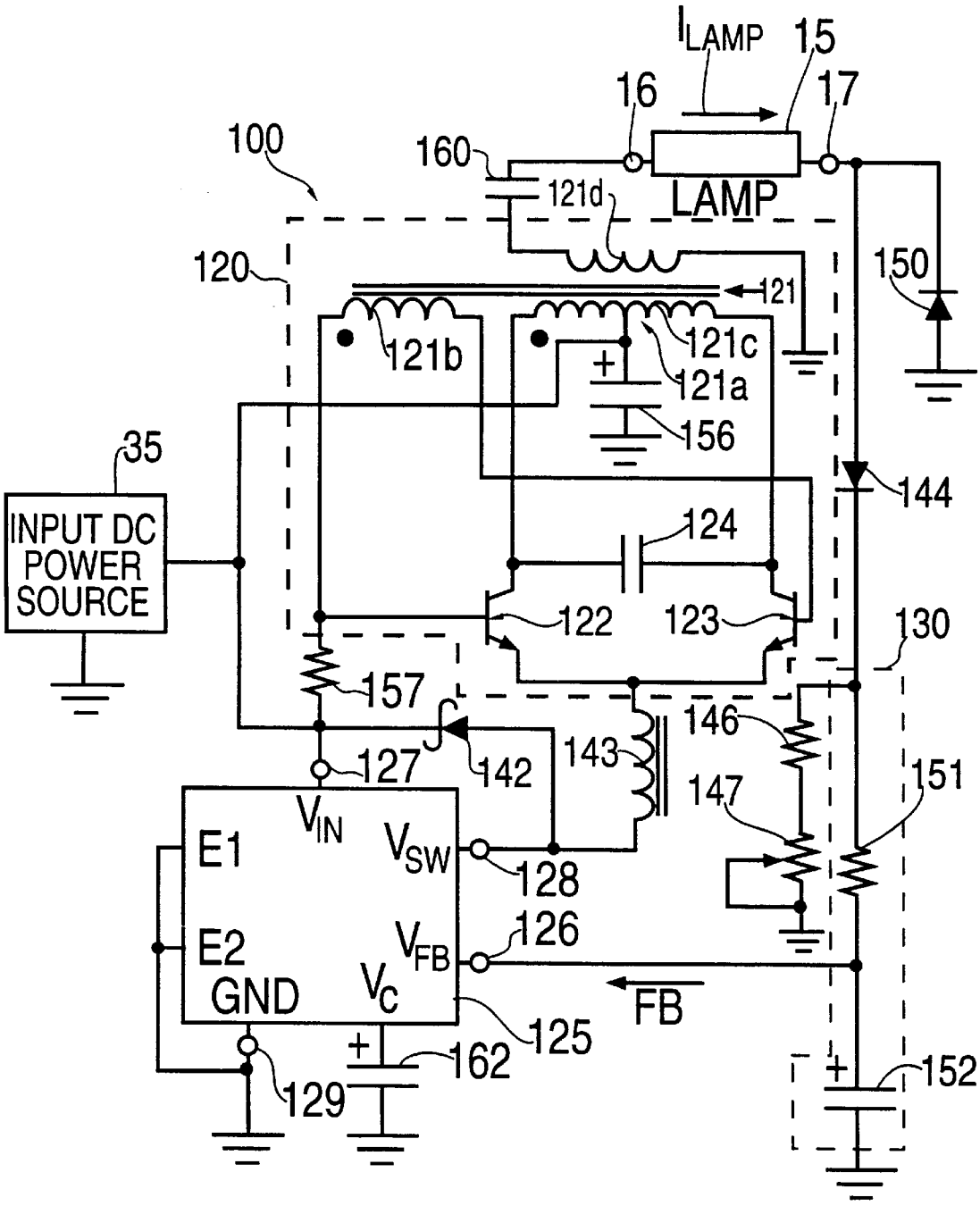
FIG. 2 is a schematic diagram of one exemplary embodiment of the fluorescent lamp power supply and control circuit of FIG. 1.

FIG. 2 is a schematic diagram of one exemplary embodiment of the fluorescent lamp power supply and control circuit of FIG. 1.

As shown in FIG. 2, input DC power source 35 supplies power for fluorescent lamp power supply and control circuit 100. Input DC power source 35, which can be any conventional power source, is used to supply low DC voltage (approximately 3–20 volts) to push-pull high-voltage inverter circuit 120 and current-mode switching regulator circuit 125. Switching regulator 125 can be any of a number of commercially available switching regulators. In the exemplary embodiment of FIG. 2, however, regulator 125 preferably is an LT-1072 integrated circuit switching regulator (available from Linear Technology Corporation of Milpitas, Calif.). When implemented using a LT-1072 switching regulator, regulator circuit 125 includes pin $V_{IN}$ (terminal 127) coupled to power source 35, terminals E1, E2 and GND coupled to ground, frequency compensating terminal $V_C$ coupled through capacitor 162 to ground, switched output pin $V_{SW}$ (terminal 128) and feedback pin $V_{FB}$ (terminal 126).

Inverter circuit 120 is a current-driven high-voltage push-pull inverter which converts the DC power from input DC power source 35 to high-voltage, sinusoidal AC. Inverter 120 is a self-oscillating circuit. Transistors 122 and 123 conduct out of phase and switch each time transformer 121 saturates. During a complete cycle, the magnetic flux density in the core of transformer 121 varies between a saturation value in one direction and a saturation value in the opposite direction. During the cycle time when the magnetic flux density varies from negative minimum to positive maximum, one of transistors 122 and 123 is ON. During the rest of the cycle time (i.e., when the magnetic flux density varies from positive maximum to negative minimum), the other transistor is ON.

Switching of transistors 122 and 123 is initiated when the magnetic flux density in transformer 121 begins to saturate. At that point in time, the inductance of transformer 121 decreases rapidly toward zero, with the result that a quickly rising high collector current flows in the transistor which is ON. This current spike is picked up by transformer bias winding 121*b* of transformer 121. Because the base terminals of transistors 122 and 123 are coupled to bias winding 121*b* of transformer 121, the current spike is fed back into the base of the transistor which produced it. As a result, that transistor drops out of saturation and into cutoff, and the transistor is turned OFF. Accordingly, the current in transformer 121 abruptly drops and the transformer winding voltages then reverse polarity resulting in the turning ON of the other transistor which previously had been OFF. The switching operation is then repeated for this second transistor.

Transistors 122 and 123 alternately switch ON and OFF at a duty cycle of approximately 50 percent. Capacitor 124, coupled between the collectors of transistors 122 and 123, causes what would otherwise be square-wave-like voltage oscillation at the collectors of transistors 122 and 123 to be substantially sinusoidal. Capacitor 124, therefore, operates to reduce RF emissions from the circuit. The frequency of oscillation is primarily set by the combination of the characteristics of transformer 121, capacitor 124 coupled between the collectors of transistors 122 and 123, fluorescent lamp 15, and ballast capacitor 160 coupled to secondary winding 121*d* of transformer 121. Capacitor 156 reduces the high frequency impedance so that transformer center tap 121*a* sees zero impedance at all frequencies.

Transformer 121 steps-up the sinusoidal voltage at the collectors of transistors 122 and 123 to produce, at secondary winding 121*d*, an AC waveform of sufficiently high voltage to drive fluorescent lamp 15 (shown coupled to secondary winding 121*d* through ballast capacitor 160). Ballast capacitor 160 inserts a controlled impedance in series with lamp 15 to minimize sensitivity of the circuit to lamp characteristics and to minimize exposure of fluorescent lamp 15 to DC components.

Inverter 120, in conjunction with current-mode switching regulator circuit 125, thus operates to deliver a controlled AC current at high voltage to terminal 16 of fluorescent lamp 15. Inductor 143, coupled between terminal 128 of regulator 125 and the emitters of transistors 122 and 123, is an energy storage element for switching regulator 125. Inductor 143 also sets the magnitude of the collector currents of transistors 122 and 123 and, hence, the energy through primary winding 121*c* of transformer 121 that is delivered to lamp 15 via secondary winding 121*d*. Schottky diode 142, coupled between input DC power source 35 and switched output pin $V_{SW}$, maintains current flow through inductor 143 during the off cycles of switching regulator circuit 125. Resistor 157 DC biases the respective bases of transistors 122 and 123.

The current delivered to lamp 15 by transformer 121 ($I_{LAMP}$) is regulated to a substantially constant value by a feedback loop including lamp 15, diode 144 and feedback circuit 130. Diode 144, in conjunction with diode 150, half-wave rectifies lamp current $I_{LAMP}$. Diode 150 shunts negative portions of each cycle of $I_{LAMP}$ to ground, and diode 144 passes positive portions of that current (representing one-half the lamp current $I_{LAMP}$) to feedback circuit 130.

Feedback circuit 130 comprises resistor 151 and capacitor 152 coupled in series between the cathode of diode 144 and ground. This produces a voltage, proportional to the magnitude of $I_{LAMP}$, across capacitor 152. This voltage (FB) is presented to the feedback pin (terminal 126) of switching regulator 125. The above connections close the feedback control loop which regulates lamp current. Resistors 146 and 147, connected in parallel with resistor 151 and capacitor 152, allow for DC adjustment in the voltage (FB) which is presented to the feedback pin.

Upon start-up of circuit 100 of FIG. 2, the voltage (FB) on feedback pin 126 of switching regulator circuit 125 is generally below the internal reference voltage of regulator circuit 125 (i.e., 1.23 volts for the LT-1072 discussed above). Thus, full duty cycle modulation at the switched output pin $V_{SW}$ (terminal 128) of regulator circuit 125 occurs. As a result, inductor 143 conducts current which flows from center tap 121*a* of transformer 121, through transistors 122 and 123, into inductor 143. This current is deposited in switched fashion to ground by the regulator's action. This switching action controls lamp 15's average current $I_{LAMP}$, the amount of which is set by the magnitude of the feedback signal FB at the feedback terminal $V_{FB}$ (terminal 126).

The feedback loop forces switching regulator 125 to modulate the output of inverter 120 to whatever value is required to maintain a constant current in lamp 15. The magnitude of that constant current can, however, be varied by variable resistor 147. Because the intensity of lamp 15 is directly related to the magnitude of the current through the lamp, variable resistor 147 thus allows the intensity of lamp 15 to be adjusted smoothly and continuously over a chosen range of intensities, including full OFF to full ON without "dead-spots" or "pop-on" at low lamp intensity.

The circuit of FIG. 2 can be implemented using commercially available components. For example, the circuit can be constructed and operated using the components and values set forth in Table 1, below:

TABLE 1

| | |
|---|---|
| Regulator 125: | LT-1072 (available from Linear Technology Corporation of Milpitas, California) |

TABLE 1-continued

| | |
|---|---|
| Transformer 121: | SUMIDA-6345-020(available from SUMIDA ELECTRIC (USA) CO., LTD., of Arlington Heights, Illinois) or COILTRONICS CTX1 10092-1 (available from Coiltronics Incorporated, of Pompano Beach, Florida) |
| Inductor 143: | 300 microhenrys (COILTRONICS CTX300-4) |
| Diodes 143, 150: | 1N4148 |
| Schottky diode 142: | 1N5818 |
| Transistors 122, 123: | MPS650 |
| Capacitor 124: | low loss 0.02 microfarad (Metalized polycarb WIMA-FKP2 (Germany) preferred) |
| Capacitor 152: | 1 microfarad |
| Capacitor 156: | 10 microfarads |
| Capacitor 160: | 33 picofarads, rated up to 3 kilovolts |
| Capacitor 162: | 2 microfarads |
| Resistor 146: | 562 ohms (1% metal film) |
| Resistor 151: | 10 kohms |
| Resistor 157: | 1 kohm |
| Variable resistor 147: | 50 kohm |

With the components of Table 1, inverter 120 oscillates at a frequency of approximately 60 kHz. With an input DC power source voltage of approximately 4.5 to 20 volts, the circuit operates at an efficiency of approximately 78 percent with approximately 1400 volts peak-to-peak appearing across the secondary of the transformer. When operating with an input DC power source voltage of approximately 3 to 5 volts, the efficiency increases to approximately 82 percent.

Figure 3:
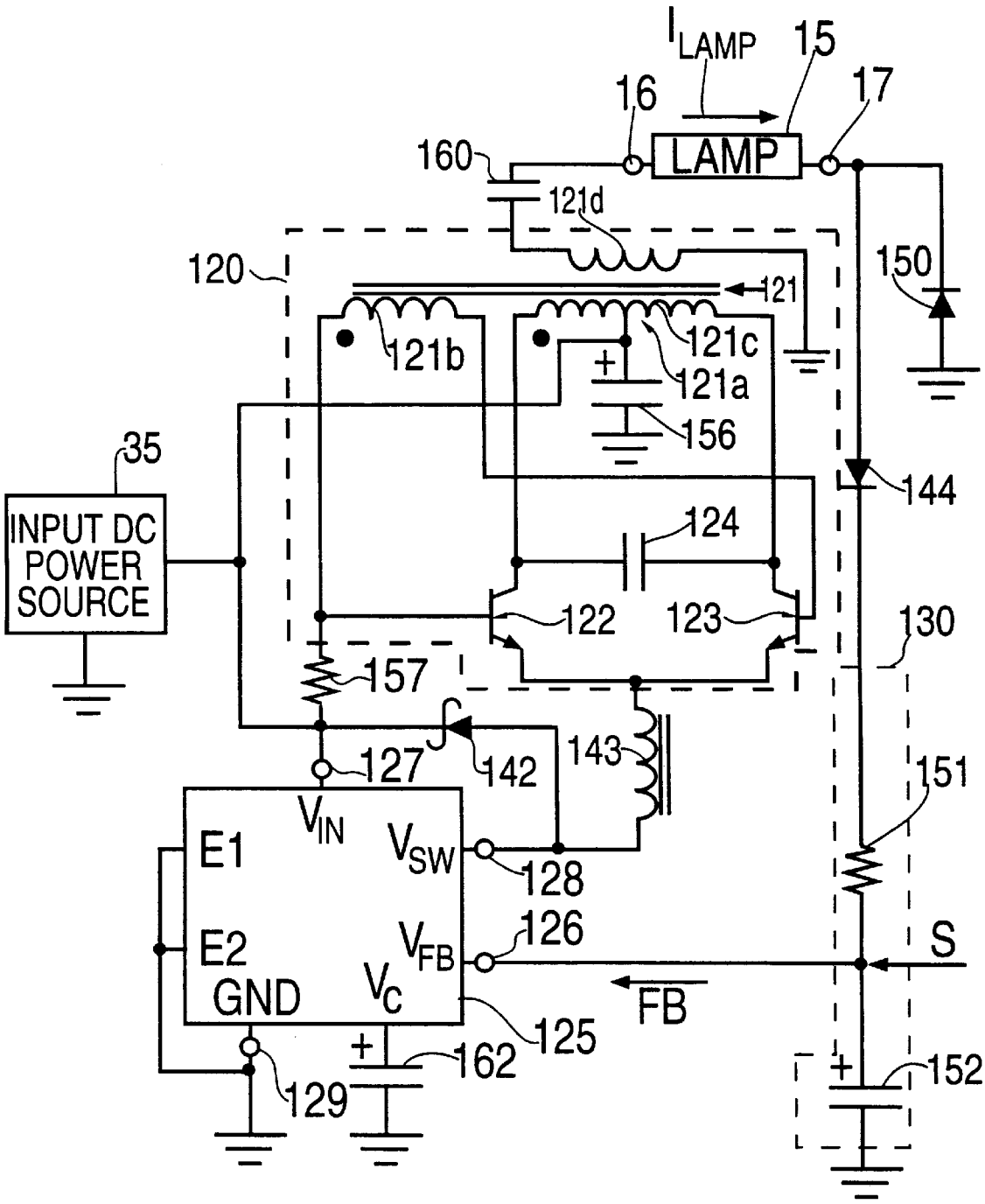
FIG. 3 is a schematic diagram of a second exemplary embodiment of the fluorescent lamp power supply and control circuit of FIG. 1.

It will be appreciated by those skilled in the art that the circuit of FIG. 2 could be modified in numerous ways without departing from the spirit and scope of the invention. For example, the intensity of lamp 15 could be varied other than by variable resistor 147 by variably introducing a signal S into the feedback loop as shown in FIG. 3. Signal S operates to vary the loop gain of the feedback loop by varying the magnitude of feedback signal FB applied to regulator 125. Just as with variable resistor 147 in FIG. 2, the introduction of signal S in FIG. 3 enables the intensity of lamp 15, to be varied without "dead-spots" or "pop-on."

For example, signal S in FIG. 3 could be taken from the output of a conventional photocell or other optical detector circuit (not shown) which monitors the intensity of ambient light. Such a circuit would enable the fluorescent lamp power supply and control circuit to compensate and adjust the fluorescent lamp intensity in response to the intensity of ambient light within the environment. Thus, when the intensity of the environmental ambient light is low, the fluorescent lamp's intensity could be regulated to a high value. Similarly, when the intensity of the environmental ambient light is high, the fluorescent lamp's intensity could be regulated to a low value. It will be appreciated by those skilled in the art, of course, that signal S could come from virtually any other circuit to cause the intensity of the fluorescent lamp to vary in some desired manner.

Figure 4A:
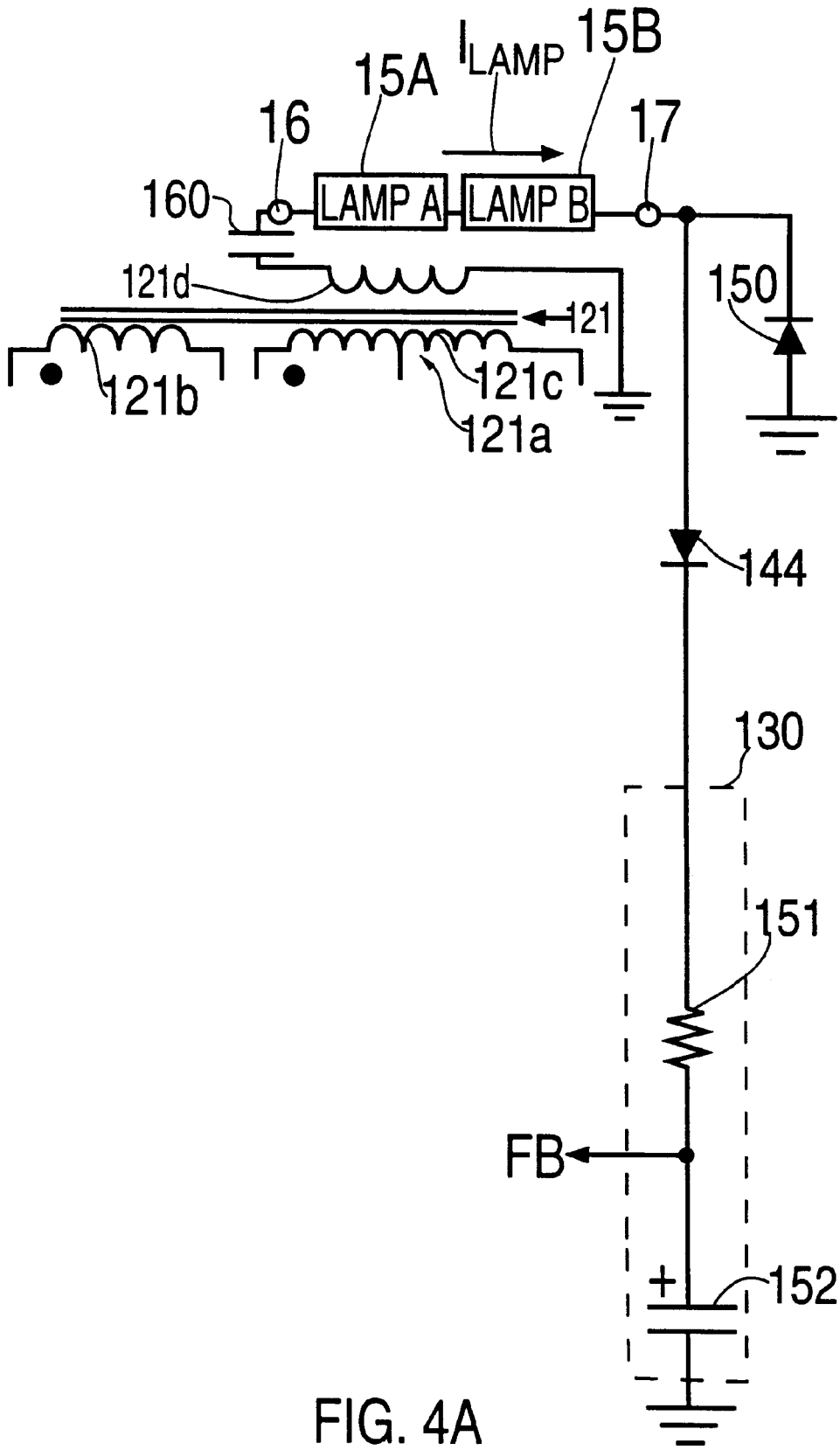
FIGS. 4A–4C are schematic diagrams showing various exemplary configurations for driving a plurality of fluorescent lamps in accordance with the principles of the present invention.
Figure 4B:
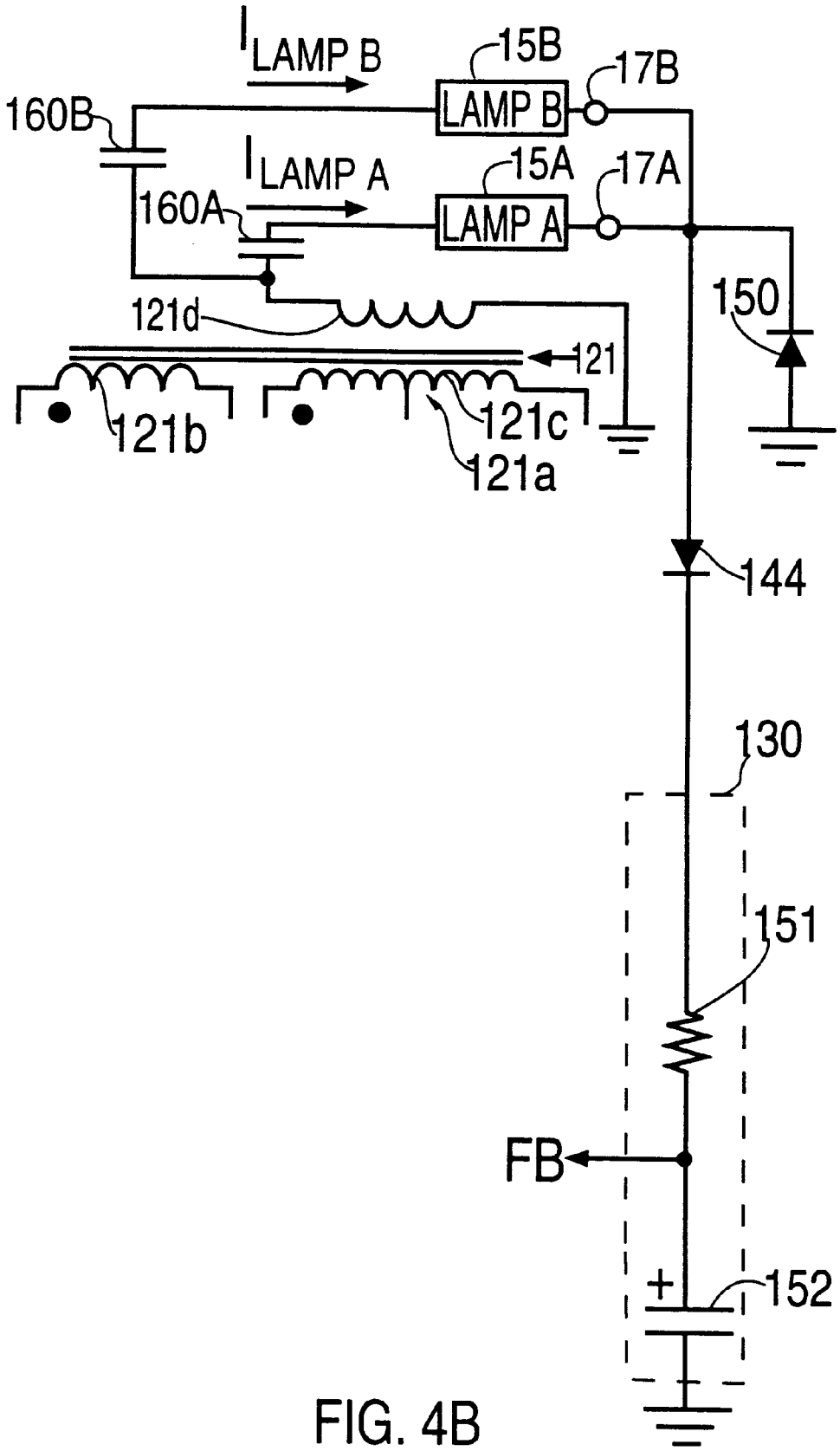
Figure 4C:
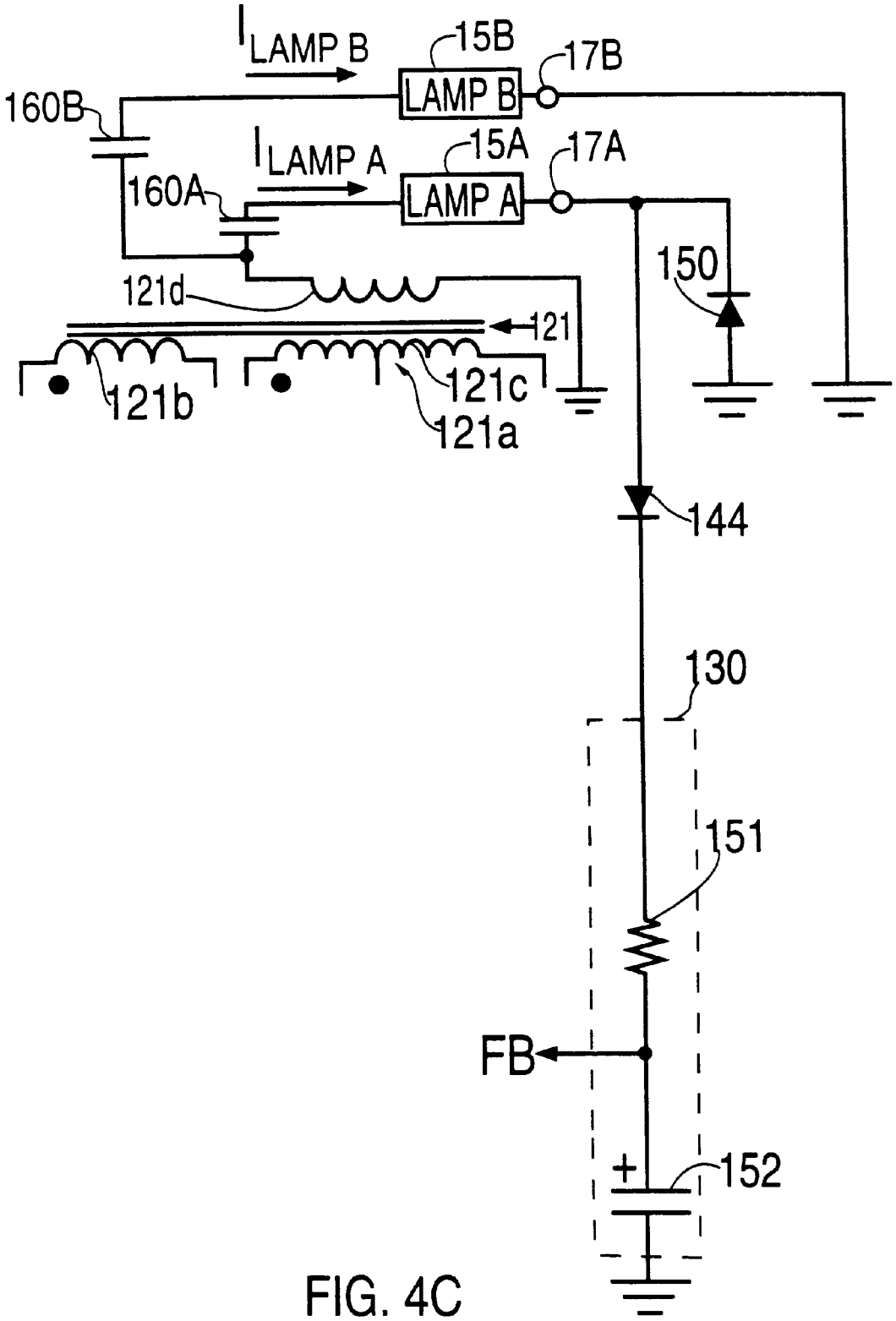

Further modifications, also within the scope of the invention, are shown in FIGS. 4A–4C, which show various exemplary circuit configurations for driving a plurality of fluorescent lamps. In the circuit of FIG. 4A, two fluorescent lamps 15A and 15B are driven in series between ballast capacitor 160 and terminal 17. Feedback circuit 130 is coupled in a fashion similar to that shown in FIG. 3 so as to sample lamp current $I_{LAMP}$ and provide current regulation.

In the circuit of FIG. 4B, two fluorescent lamps 15A and 15B, each with their own series-connected ballast capacitors 160A and 160B, respectively, are driven in parallel. Terminals 17A and 17B of lamps 15A and 15B, respectively are coupled together. Feedback circuit 130 is coupled commonly to terminals 17A and 17B of lamps 15A and 15B, respectively, and thus samples the combined lamp current $I_{LAMPA}+I_{LAMPB}$ so as to provide current regulation. Furthermore, although ballast capacitors 160A and 160B are shown in FIG. 4B coupled commonly to secondary winding 121*d,* they could also be coupled to separate windings on the secondary side of transformer 121. Thus, transformer 121 could include a plurality of secondary windings with each lamp respectively coupled to the different windings through its respective ballast capacitor.

In the circuit of FIG. 4C, two fluorescent lamps 15A and 15B, each with their own series-connected ballast capacitors 160A and 160B, respectively, are driven under similar drive conditions (i.e., pseudo-parallel). However, feedback circuit 130 is coupled only to lamp 15A (via terminal 17A) so that only lamp current $I_{LAMPA}$ through lamp 15A is sampled to provide feedback. Although lamp 15B is not included within the feedback loop, its intensity will also be regulated to a substantially constant value if the operating characteristics of lamp 15B are similar to those of lamp 15A. Furthermore, although ballast capacitors 160A and 160B are shown in FIG. 4C coupled commonly to secondary winding 121*d,* they could also be coupled to separate windings on the secondary side of transformer 121. Thus, transformer 121 could include a plurality of secondary windings with each lamp respectively coupled to the different windings through its respective ballast capacitor.

FIGS. 5A–5D show various exemplary configurations of another embodiment in accordance with a further aspect of the invention in which a fluorescent lamp's output is indirectly monitored and in which the lamp may be floated across the terminals of an output transformer. FIGS. 5A–5D are simplified diagrams of circuits to provide regulation of a fluorescent lamp over an extended range of intensities, such that the lamp's intensity is more consistently distributed along the longtitudal length of the lamp. Although the circuits shown in FIGS. 5A–5D are particularly effective for operating cold cathode fluorescent lamps, the circuits of FIGS. 5A–5D may also be used to drive hot cathode flourescent lamps (i.e., the hot cathode filaments are driven as if they were cold cathode electrodes).

Figure 5A:
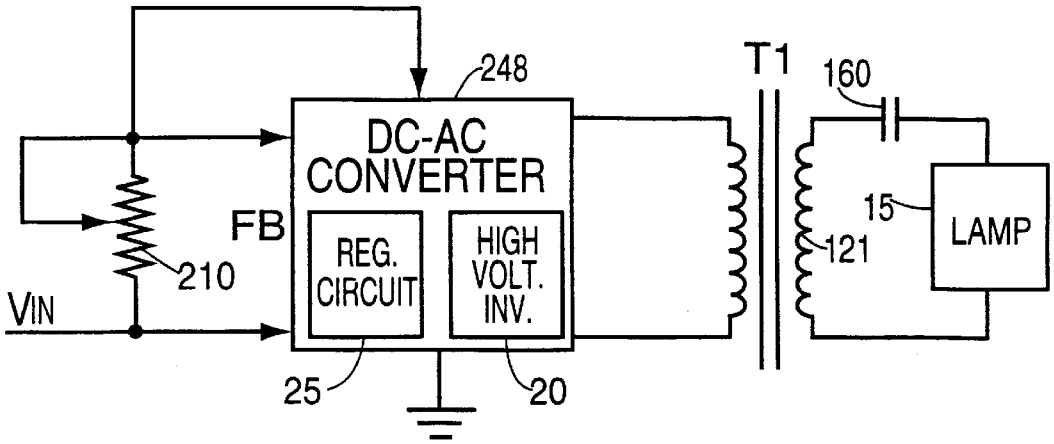
FIGS. 5A–5D are schematic block diagrams showing various exemplary configurations of another embodiment in accordance with a further aspect of the invention in which a fluorescent lamp's output is indirectly monitored and in which the lamp is floated across the terminals of an output transformer.

As shown in FIG. 5A, a DC-AC converter 248 drives the primary coil of transformer 121. Converter 248 is a simplified representation of various components shown in FIG. 1, and includes at least high voltage inverter 20 and regulator 25. The terminals of the secondary coil of transformer 121 are coupled across a cold cathode fluorescent lamp 15. A conventional ballast capacitor 160 is also shown coupled in series with the lamp 15.

Regulation of lamp 15 is provided by supplying a feedback signal to converter 248. The feedback signal, developed across an impedance 210 (shown as a resistor, although other suitable forms of impedance may be used), is proportional to the input current. The feedback signal is coupled to converter 248 to regulate lamp 15 and, hence, the amount of light emitted by the lamp 15. This feedback signal, which indirectly monitors the lamp's drive power, differs from the arrangement shown in FIGS. 1–4 in which a feedback signal is extracted directly from the lamp output circuitry. Additionally, impedance 210 is preferably a variable impedance which receives user inputs that cause converter 248 to vary the intensity of lamp 15 correspondingly.

Floating lamp 15 across the secondary output of transformer 121 to isolate the lamp from its drive circuitry, and indirectly measuring the drive provided to the lamp, is advantageous because no connection is involved which would cause asymmetrical drive to the lamp 15. This results in a more uniformly distributed electric field within the lamp, which enhances the lamp's ability to uniformly emit light along its entire length at lower operating currents. An additional benefit is that a lower amplitude waveform out of transformer 121 may be used to operate the lamp.

Figure 5B:
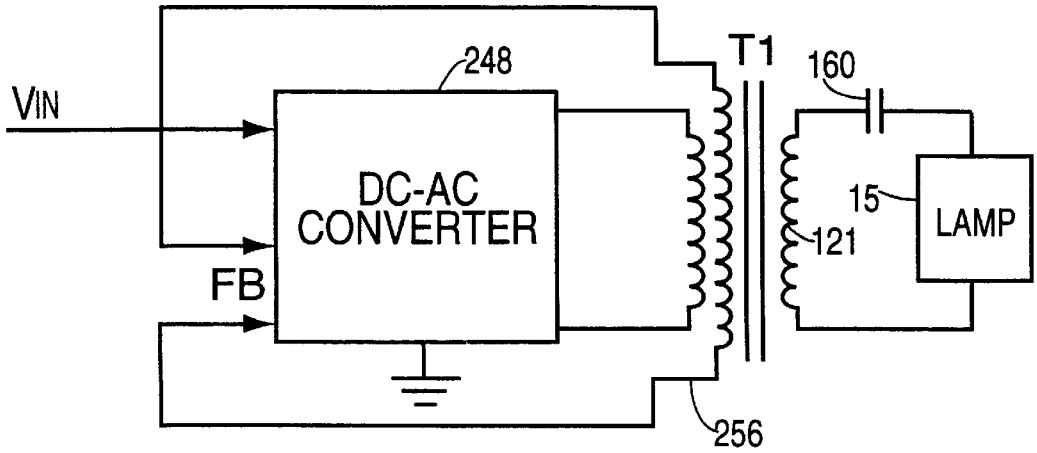

FIG. 5B shows another way to monitor indirectly the input power and, hence, the drive current of lamp 15. In FIG. 5B, transformer 121 is the same as transformer 121 of FIG. 5A, except that is provided with an additional winding 256 on the primary side. Winding 256 senses the magnetic flux induced in the transformer 121, and responsively generates a signal proportional to that flux. This signal indirectly monitors the drive to the lamp, because it is indicative of the energy transferred to the lamp. Additional winding 256 may be wound simultaneously during the winding of transformer 121 (as a trifilar winding) to provide a more precise measurement of the flux of the primary, or it may be separately wound. In either event, the signal generated by winding 256 is coupled to converter 248, as shown in FIG. 5B, as a feedback signal to regulate current through lamp 15 as hereinbefore described. It will, of course, be appreciated by persons skilled in the art that other magnetic elements may be utilized in addition to, or in substitution for, winding 256 to magnetically monitor the energy delivered from converter 248 to lamp 215.

Figure 5C:
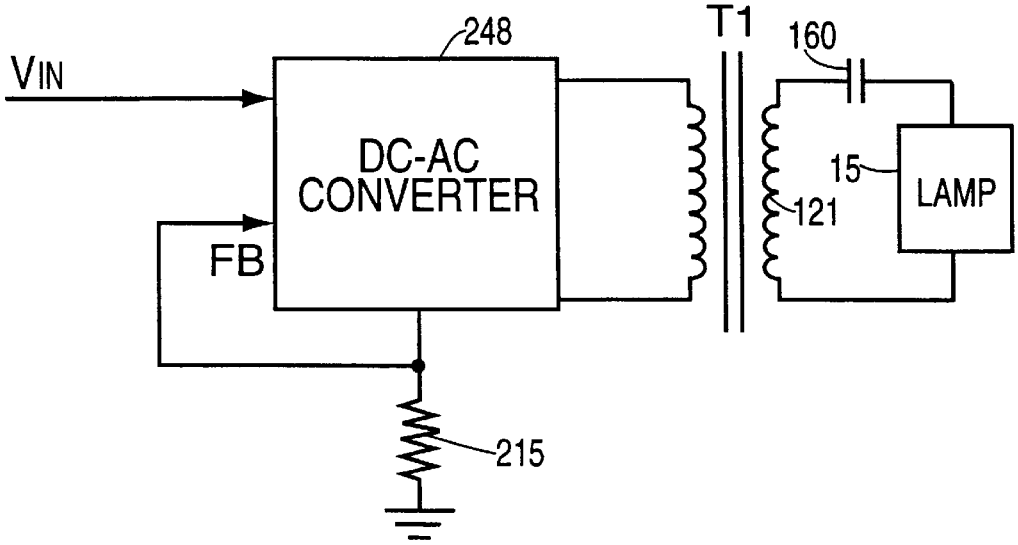

FIG. 5C shows yet another way to indirectly monitor the drive to lamp 215. In FIG. 5C, the current passing through the return (ground) terminal of converter 248 is monitored via impedance 215 (shown as a resistor, although other suitable forms of impedance could be used) coupled in series between converter 248 and ground. The voltage developed across impedance 215 is used as a feedback signal, and coupled as shown to a feedback terminal of converter 248 to control the lamp's drive as hereinbefore described. One disadvantage of the approach of FIG. 5C, as compared to that of FIG. 5A, is that additional signal processing within or around converter 248 may be required to obtain good regulation as operating conditions change. This is so because the return line of converter 248 typically contains highly non-linear signal components.

Figure 5D:
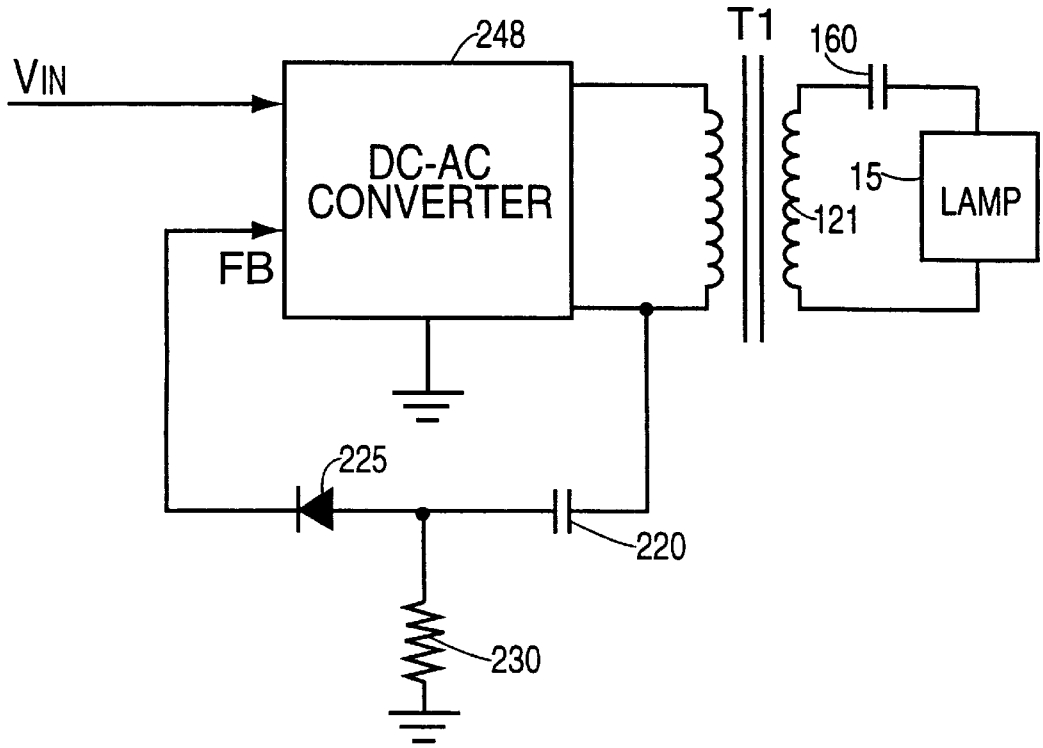

FIG. 5D shows still another way to monitor indirectly the drive provided to lamp 15. In this figure, feedback signal FB is generated by sampling a portion of transformer 121's primary AC voltage signal. The feedback loop includes capacitor 220, one terminal of which is coupled to a terminal of the primary winding of transformer 121. The other terminal of capacitor 220 is coupled to the anode of diode 225 and to a first terminal of impedance 230. The other terminal of impedance 230 is coupled to ground, while the cathode of diode 225 is coupled to the feedback input terminal of converter 248.

It will be understood by persons skilled in the art that other circuit arrangements for indirectly monitoring the drive to lamp 215 may be used, and that the circuits of FIGS. 5A–5D are intended only to be representative, but not exhaustive, of such circuits. It should also be apparent to persons skilled in the art that indirect measurement of the drive to the lamp does not require floating the lamp from the drive circuitry, and that indirect measurement may be accomplished even where the windings of the transformer are directly coupled. For example, any of the indirect measurement techniques shown in FIGS. 5A–5D can be applied to any of the lamp configurations shown in FIGS. 2, 3 and 4A–4C (where the transformer secondary winding is coupled to a common ground).

Figure 6:
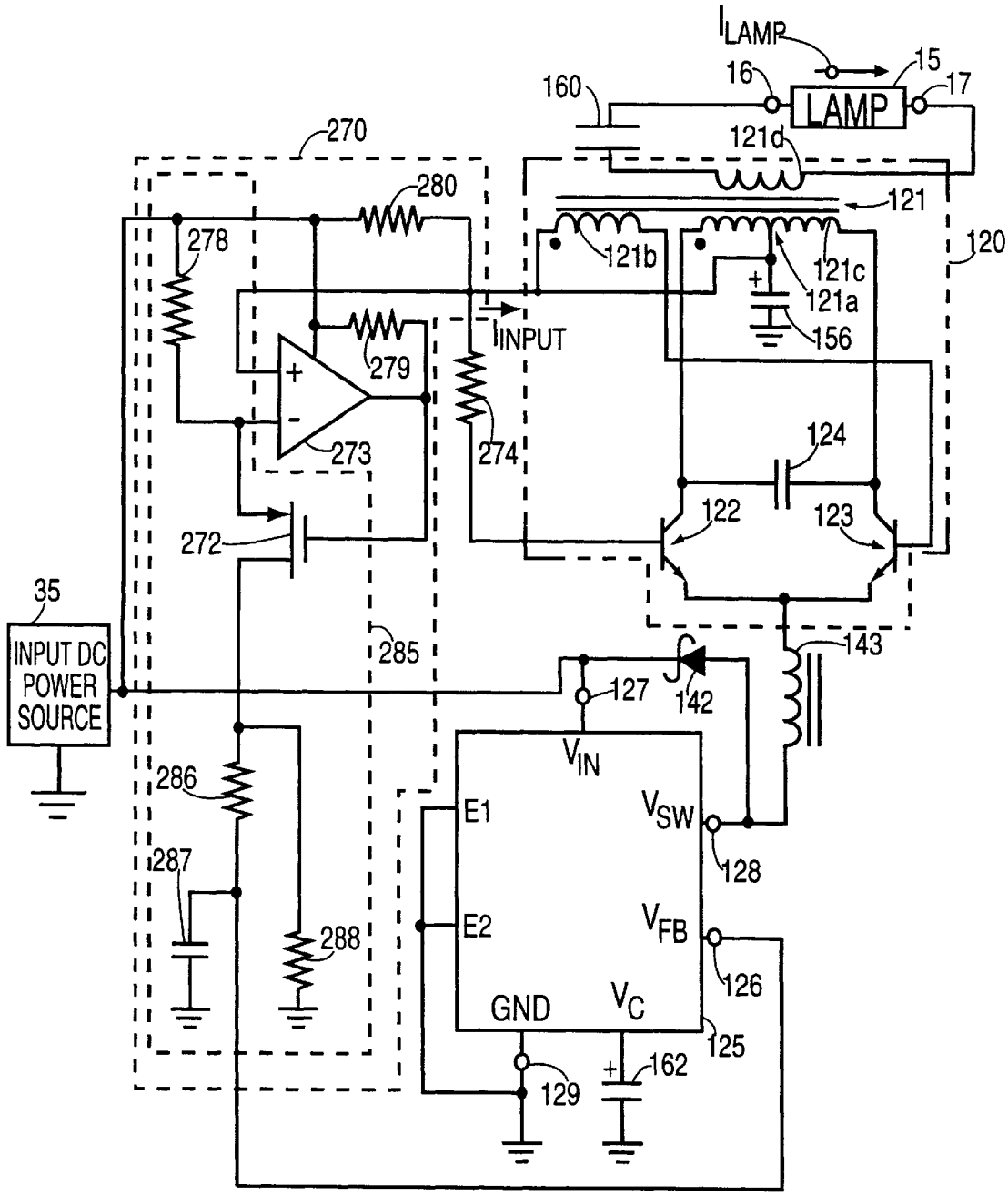
FIG. 6 is a schematic diagram of a first exemplary circuit employing the principles of the circuits of FIGS. 5A–5D.

FIG. 6 shows an exemplary circuit employing the principles of the circuit of FIG. 5A. More particularly, FIG. 6 shows circuitry of FIGS. 2 and 3, but modified in accordance with the principles discussed with respect to FIG. 5A so that lamp 15 is symmetrically driven to enhance the uniformity of the light emitted along the length of the lamp's tube.

As described in connection with FIGS. 2 and 3, the circuit of FIG. 6 includes inverter 120 and current mode switching regulator 125. Inverter 120, in conjunction with regulator 125, operates to deliver a controlled AC current at high voltage to terminal 16 of fluorescent lamp 15. In FIG. 6, however, the coupling of lamp 15 to the secondary winding 121*d* is changed so that lamp 15 is floated across the winding. This arrangement causes the drive to lamp 15 to be symmetrical, thus causing its light output along the length of the lamp's tube to be more uniformly distributed as heretofore discussed.

Also changed in FIG. 6 is the circuitry to sense and regulate the flow of current in the tube. In FIG. 6, this sensing is done indirectly (i.e., without direct electrical connection to the loop including the lamp) in order to avoid introducing undesirable asymmetry into the lamp's drive. An additional change in FIG. 6 is that the DC bias for transistor 122 (within inverter 120) is set by resistor 274 which is coupled to the base of transistor 122.

The circuitry to regulate the current to lamp 15 comprises current sensing circuit 270. Circuit 270 provides a feedback signal to regulator 125 (at $V_{FB}$) that is proportional to the input current INPUT of inverter circuit 120 as follows. Input DC power source 35 applies power to the negative input of operational amplifier 273 through resistor 278, and to the positive input through shunt resistor 280. Amplifier 273 generates a voltage signal that is proportional to the current sensed across shunt resistor 280 (the input current to inverter 120). This voltage signal is coupled to the base of FET switch 272 of feedback circuit 285. The output signal causes FET switch 272 to saturate, thereby creating a low resistance conductive path across the switch such that the drain voltage of switch 272 represents an amplified, single-ended version of the shunt voltage. Resistors 278, 279, and 280 of feedback circuit 285 are chosen to ensure that FET switch 272 fully saturates.

Feedback circuit 285 includes resistors 278 and 286 coupled in series with switch 272. Capacitor 287 and resistor 288 are coupled from resistor 286 to ground, with the capacitor 287 being coupled to the terminal of resistor 286 that is coupled to the feedback terminal of switching regulator 125. Feedback circuit 285 produces a voltage that is proportional to the magnitude of $I_{INPUT}$, in the form of the shunt voltage, across capacitor 287. This voltage is presented as feedback signal FB to the feedback pin (terminal 126) of switching regulator 125 to close the feedback control loop which regulates lamp current. Resistor 288 allows for DC adjustment in the voltage (FB) presented to the feedback pin.

The current sensing circuit 270 of FIG. 6 can be implemented using commercially available components. Exemplary components are set forth in Table 2, below:

TABLE 2

| | |
|---|---|
| Operational Amplifier 273: | LT-307A (available from Linear Technology Corporation of Milpitas, California) |
| N-Channel FET Switch 272: | TP0610 (available from Siliconix of Santa Clara, California) |
| Resistor 274: | 1 kohm |
| Resistor 278: | 499 ohms |

TABLE 2-continued

| | |
|---|---|
| Resistor 279: | 100 kohms |
| Resistor 280: | 0.3 ohm |
| Resistor 286: | 10 kohms |
| Resistor 288: | 4.99 kohm |
| Capacitor 287: | 10 microfarads |

Figure 7:
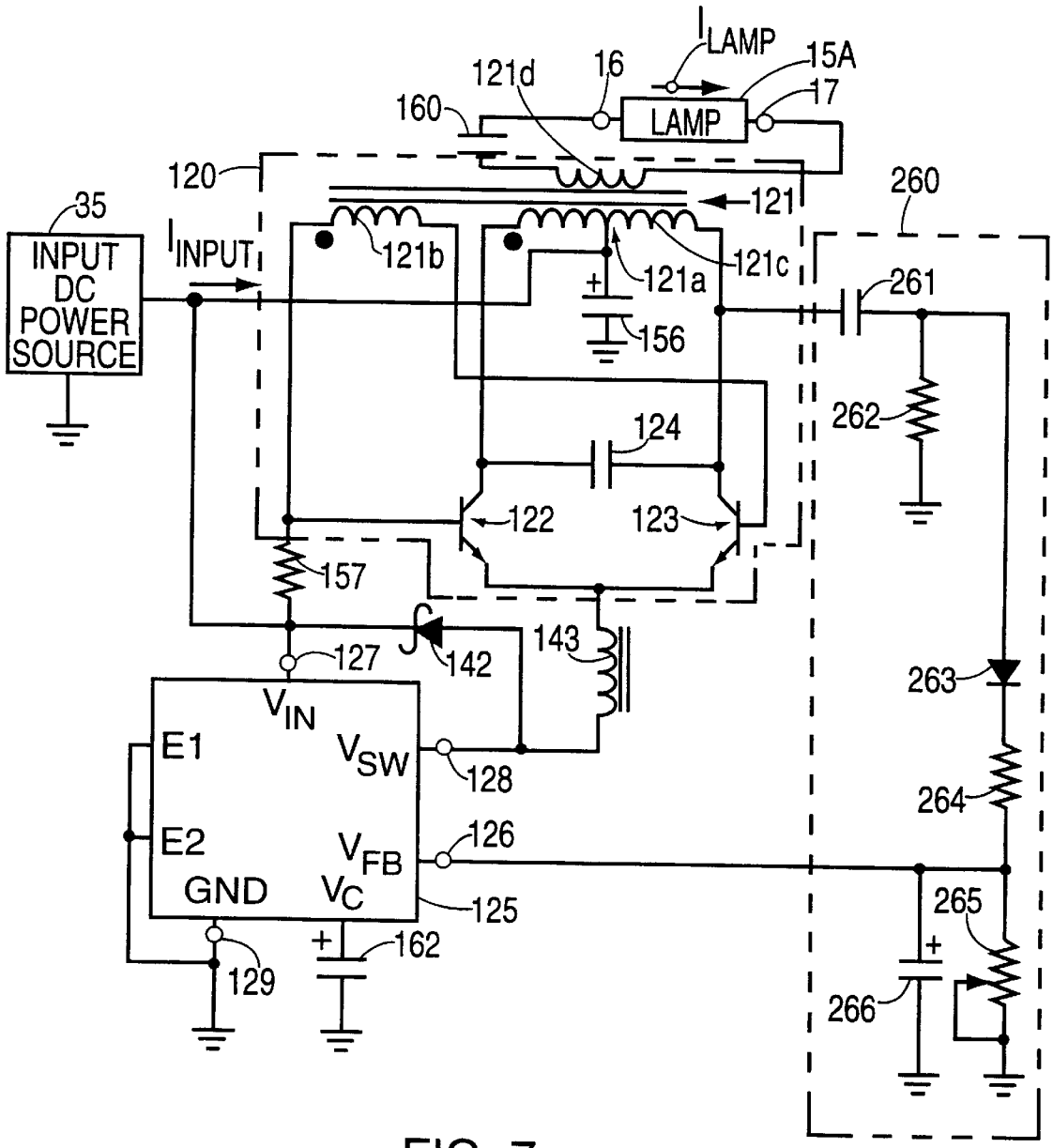
FIG. 7 is a schematic diagram of a second exemplary circuit employing the principles of the circuits of FIGS. 5A–5D.

FIG. 7 illustrates another exemplary circuit employing the principles of the circuit of FIG. 5D. FIG. 7 shows circuitry of FIGS. 2 and 3 modified in accordance with the principles discussed with respect to FIG. 5D, so that lamp 15 is symmetrically driven to enhance the uniformity of the light emitted along the length of the lamp's tube.

As described in connection with FIGS. 2 and 3, the circuit of FIG. 7 includes inverter 120 and regulator 125. Inverter 120, in conjunction with regulator 125, operates to deliver a controlled AC current at high voltage to terminal 16 of fluorescent lamp 15. In FIG. 7, however, the coupling of lamp 15 to the secondary winding 121*d* is changed so that lamp 15 is coupled across the winding. As discussed with respect to FIG. 6, this arrangement causes the drive to lamp 15 to be symmetrical, its light to be more uniformly distributed.

Also changed in FIG. 7 is the circuitry to sense and regulate the flow of current in the tube. In FIG. 7, this sensing is done indirectly by current sensing circuit 260. Circuit 260 monitors the AC voltage across the primary winding of transformer 121 and provides a feedback signal voltage that is proportional to input current ($I_{INPUT}$), to the inverter circuit 120. The current sensing circuit 260 includes capacitor 261, which couples the AC signal from the primary winding of transformer 121 resistor 262 and the anode of diode 263. Diode 263 half-wave rectifies the AC output signal of transformer 121. Resistor 264 and variable resistor 265 produce a voltage across capacitor 266 that is proportional to the input current of inverter 120. This voltage is coupled as signal FB to the feedback pin of regulator 125. Variable resistor 265 allows for DC adjustment in the signal voltage (FB), so that a user can vary the intensity of lamp 15.

The current sensing circuit 260 of FIG. 7 can also be implemented using commercially available components. For example, the circuit can be constructed and operated using the following components and values:

TABLE 3

| | |
|---|---|
| Resistor 262: | 10 kohms |
| Resistor 264: | 20 kohms |
| Resistor 265: | 18 kohms |
| Capacitor 261: | .01 microfarads |
| Capacitor 266: | 1 microfarad |
| Diode 263 | 1N4148 |

Figure 8A:
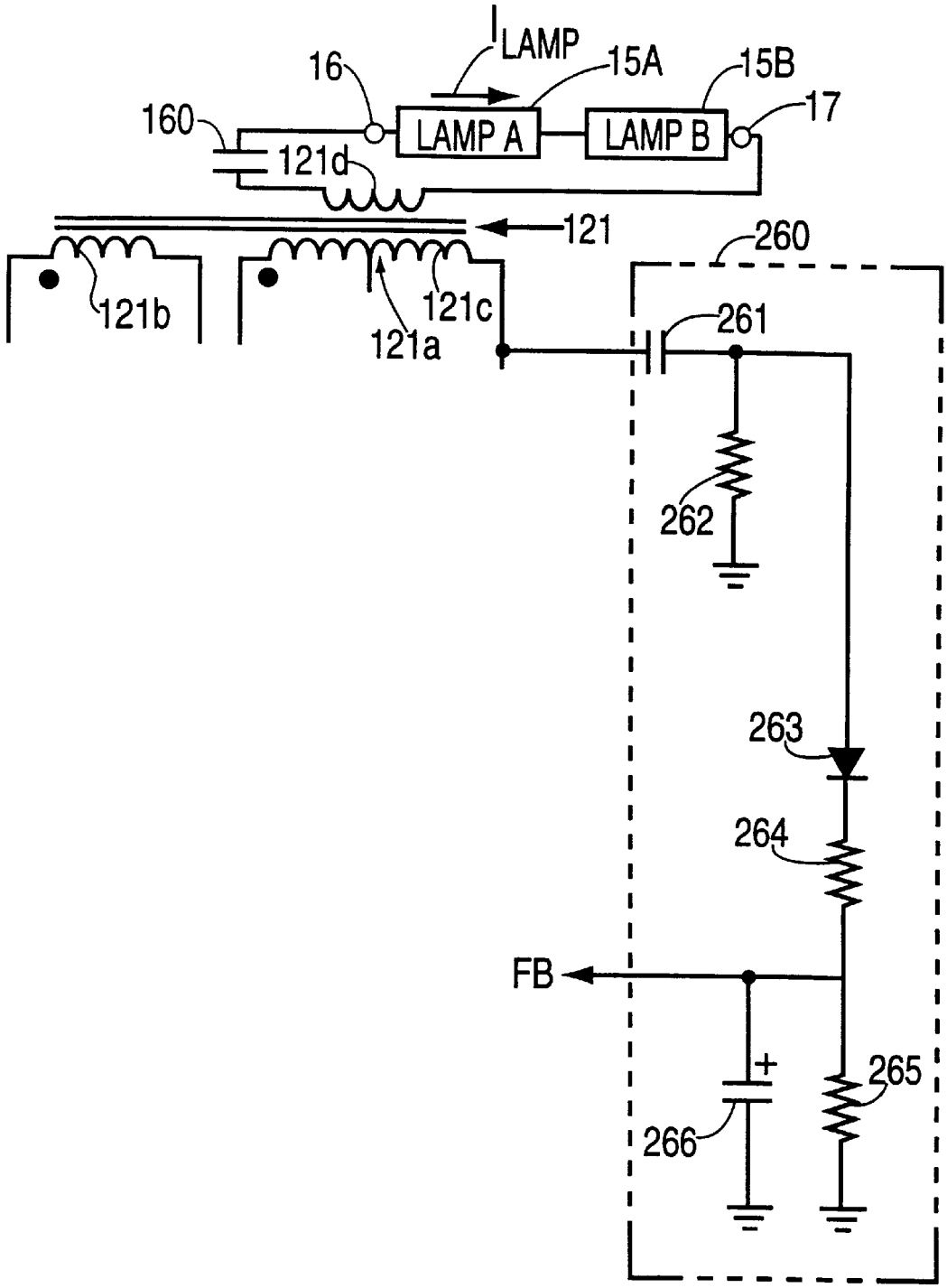
FIGS. 8A–8B are schematic diagrams showing various exemplary configurations for driving a plurality of fluorescent lamps in accordance with the principles of the circuits of FIGS. 5A–D.
Figure 8B:
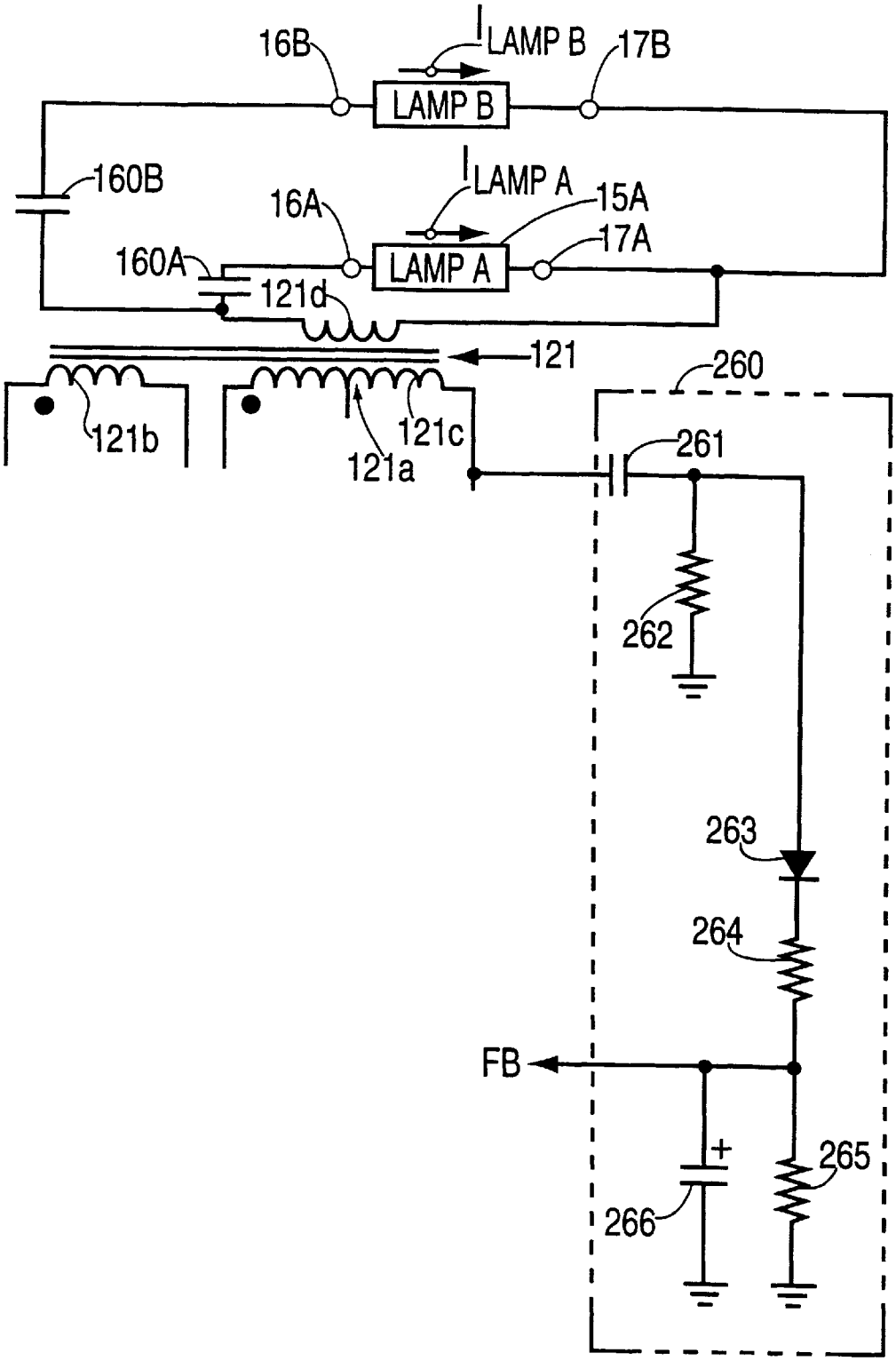

Further modifications, also within the scope of this embodiment of the invention, are shown in FIGS. 8A and 8B, which show a plurality of fluorescent lamps being driven symmetrically. In the circuit of FIG. 8A, two fluorescent lamps 15A and 15B are driven in series between ballast capacitor 160 and terminal 17. Feedback circuit 160 is coupled in a fashion similar to that shown in FIG. 7 so as to sample the current passing through the primary winding of the transformer and provide indirect current regulation of lamps 15A and 15B. As in the circuit of FIG. 7, a feedback signal is generated that is proportional to the current input to the inverter.

In the circuit of FIG. 8B, two fluorescent lamps 15A and 15B, each with their own series-connected ballast capacitors 160A and 160B, respectively, are driven in parallel. Terminals 17A and 17B of lamps 15A and 15B, respectively are coupled together. Feedback circuit 260 is coupled to the primary winding of the transformer to provide indirect current regulation of lamps 15A and 15B (in the same manner as shown and described with regard to FIG. 7). Furthermore, although ballast capacitors 160A and 160B are shown in FIG. 7E coupled commonly to secondary winding 121*d*, they could also be coupled to separate windings on the secondary side of transformer 121. Thus, even in the indirect monitoring configuration, transformer 121 could include a plurality of secondary windings with each lamp respectively coupled to the different windings through its respective ballast capacitor.

Persons of ordinary skill in the art will recognize that the power supply and control circuit of the present invention could be implemented using circuit configurations other than those shown and discussed above. All such modifications are within the scope of the present invention, which is limited only by the claims which follow.

What is claimed is:

1. A circuit for operating a fluorescent lamp from a source of DC power, the circuit comprising:

a regulator having an input adapted to be coupled to the DC power source, an output, and a control terminal adapted for receiving a feedback signal to control the output;

an inductive storage element coupled to the output of the regulator for producing a drive current;

a DC-to-AC inverter, adapted for being driven by the drive current, for producing at an output terminal an AC voltage sufficient to cause a current to be conducted through the fluorescent lamp so that the lamp emits light; and a circuit for indirectly monitoring the current delivered to the fluorescent lamp and for generating the feedback signal indicative of that current, the feedback signal being coupled to the control terminal of the regulator to control the drive current to regulate the current conducted and the intensity of light emitted by the lamp.

2. The circuit of claim 1, wherein the lamp and inverter are coupled such that the lamp is isolated from the inverter.

3. The circuit of claim 1, further including a feedback signal adjusting circuit to responsively adjust the current conducted by the fluorescent lamp, whereby the intensity of light emitted by the fluorescent lamp can be smoothly and continuously varied over a range of intensities.

4. The circuit of claim 1, further including a feedback signal adjusting circuit to responsively adjust the current conducted by the fluorescent lamp, whereby the intensity of light emitted by the fluorescent lamp can be smoothly and continuously varied from substantially full OFF to full ON.

5. The circuit of claim 1, wherein the AC voltage output produced by the DC-to-AC inverter is substantially sinusoidal.

6. The circuit of claim 1, wherein the fluorescent lamp is coupled to a ballast capacitor.

7. The circuit of claim 1, wherein the feedback signal generated by the indirect monitoring circuit is proportional to the current conducted by the fluorescent lamp.

8. The circuit of claim 7, wherein the indirect monitoring circuit includes an impedance adapted to be coupled in series with the regulator control terminal, and the feedback signal comprises a voltage developed across at least a portion of the impedance.

9. The circuit of claim 8 further including a rectifying circuit adapted to be coupled in series between the inverter and the monitoring circuit for rectifying the current conducted by the inverter so that the monitoring circuit monitors rectified current.

10. The circuit of claim 3, wherein the indirect monitoring circuit includes a first impedance adapted to be coupled in series with the regulator control terminal and the feedback signal comprises a voltage developed across at least a portion of the first impedance, and wherein the feedback signal adjusting circuit comprises a variable impedance coupled in series with at least a portion of the first impedance, the variable impedance having a range of adjustment sufficient to vary the intensity of the fluorescent lamp over a range including substantially full OFF to full ON.

11. The circuit of claim 1 wherein the output terminal of the DC-to-AC inverter is adapted to be coupled to generate a current through a plurality of fluorescent lamps.

12. The circuit of claim 11 wherein the plurality of fluorescent lamps are coupled in series.

13. The circuit of claim 11 wherein the plurality of fluorescent lamps are coupled in parallel and the monitoring circuit is adapted to monitor the combined currents conducted by the fluorescent lamps.

14. The circuit of claim 1, wherein the regulator is a switching regulator.

15. The circuit of claim 1, wherein the regulator is a current mode switching regulator.

16. A circuit for operating a fluorescent lamp from a source of DC power, the circuit comprising:

a regulator having an input adapted to be coupled to the DC power source, an output, and a control terminal adapted for receiving a feedback signal to control the output;

an inductive storage element coupled to the output of the regulator for producing a drive current;

a DC-to-AC inverter, adapted for being driven by the drive current, for producing an AC voltage at an output of the inverter;

means for coupling the fluorescent lamp to the inverter; and means for indirectly monitoring the current delivered to the lamp and for generating the feedback signal indicative of the magnitude of the current conducted by the lamp current, the feedback signal being coupled to the control terminal of the regulator to control the drive current to regulate the current conducted and the intensity of light to be emitted by the lamp.

17. The circuit of claim 16, wherein the means for coupling isolates the lamp from the inverter.

18. The circuit of claim 16, further including feedback signal adjusting means to responsively adjust the current conducted by the fluorescent lamp, whereby the intensity of light emitted by the fluorescent lamp can be smoothly and continuously varied over a range of intensities.

19. The circuit of claim 16, further including feedback signal adjusting means to responsively adjust the current conducted by the fluorescent lamp, whereby the intensity of light emitted by the fluorescent lamp can be smoothly and continuously varied from substantially full OFF to full ON.

20. The circuit of claim 16, wherein the AC voltage output produced by the DC-to-AC inverter is substantially sinusoidal.

21. The circuit of claim 16, wherein the fluorescent lamp is coupled to a ballast capacitor.

22. The circuit of claim 16, wherein the feedback signal generated by the monitoring means is proportional to the current conducted by the fluorescent lamp.

23. The circuit of claim 22, wherein the monitoring means includes an impedance adapted to be coupled in series with the regulator control terminal, and the feedback signal comprises a voltage developed across at least a portion of the impedance.

24. The circuit of claim 23 further including a rectifying circuit means adapted to be coupled in series between the inverter and the means for monitoring for rectifying the current conducted by the inverter so that the means for monitoring monitors rectified current.

25. The circuit of claim 18, wherein the monitoring means includes a first impedance adapted to be coupled in series with the regulator control terminal and the feedback signal comprises a voltage developed across at least a portion of the first impedance, and wherein the feedback signal adjusting means comprises a variable impedance coupled in series with at least a portion of the first impedance, the variable impedance having a range of adjustment sufficient to vary the intensity of the fluorescent lamp over a range including substantially full OFF to full ON.

26. The circuit of claim 16 wherein the output of the DC-to-AC inverter is adapted to be coupled to generate a current through a plurality of fluorescent lamps.

27. The circuit of claim 26 wherein the plurality of fluorescent lamps are coupled in series.

28. The circuit of claim 26 wherein the plurality of fluorescent lamps are coupled in parallel and the means for monitoring is adapted to monitor the combined currents conducted by the fluorescent lamps.

29. The circuit of claim 16, wherein the regulator is a switching regulator.

30. The circuit of claim 16, wherein the regulator is a current mode switching regulator.

31. A circuit for operating a fluorescent lamp from a source of DC power, the circuit comprising:

a regulator for producing a regulated DC output, the regulator having an input for receiving a feedback signal to control the output;

a DC-to-AC inverter coupled to the regulated output for producing an AC voltage;

a transformer having a first winding coupled to the AC output and having a second winding adapted to be coupled to the fluorescent lamp; and a circuit for indirectly monitoring the current conducted by the fluorescent lamp, the circuit generating the feedback signal to regulate the light emitted by the lamp.

32. The circuit of claim 31, wherein the second winding is adapted to be coupled to the lamp such that the lamp is isolated from inverter.

33. The circuit of claim 31, further including an adjustment circuit for varying the feedback signal to responsively vary the current conducted by the fluorescent lamp, whereby the intensity of the fluorescent lamp can be smoothly and continuously controlled over a range of intensities.

34. The circuit of claim 31, further including an adjustment circuit for varying the feedback signal to responsively vary the current conducted by the fluorescent lamp, whereby the intensity of the fluorescent lamp can be smoothly and continuously controlled from substantially full OFF to full ON.

35. The circuit of claim 31, wherein the circuit for indirectly monitoring further includes:

a rectifier for rectifying the current conducted by the first winding;

a resistance coupled in series with the rectifier; and a capacitance coupled in series with the resistance for filtering the rectified first winding current; and wherein:

the feedback signal comprises a voltage developed across the capacitance.

36. The circuit of claim 35, further including:

a variable resistance coupled to the circuit for indirectly monitoring to vary the magnitude of the feedback signal and to responsively vary the current conducted by the fluorescent lamp, whereby the intensity of the fluorescent lamp can be smoothly and continuously adjusted.

37. The circuit of claim 31 wherein the second winding of the transformer is adapted to be coupled to a plurality of fluorescent lamps.

38. The circuit of claim 37 wherein the plurality of fluorescent lamps are coupled in series.

39. The circuit of claim 37 wherein the plurality of fluorescent lamps are coupled in parallel and the circuit for monitoring is adapted to monitor the combined currents conducted by the fluorescent lamps.

40. A circuit for operating a fluorescent lamp from a source of DC power, the circuit comprising:

a current-mode switching regulator having an input adapted to be coupled to the source of DC power, an output, and a control terminal adapted for receiving a signal to control the current produced at the output;

an oscillator coupled to the output of the switching regulator, the oscillator producing an AC voltage;

a step-up transformer having a primary winding, and a secondary winding adapted to be coupled to the fluorescent lamp, the primary winding being coupled to the oscillator to transform the AC voltage produced by the oscillator to a high AC voltage across the secondary winding sufficient to operate the fluorescent lamp; and a current sensing circuit including an impedance adapted to conduct at least a portion of the current input to the primary winding of the transformer to generate a feedback signal proportional to that current, the current sensing circuit being coupled to conduct the feedback signal to the switching regulator to regulate the current conducted and the intensity of light emitted by the fluorescent lamp.

41. The circuit of claim 40, wherein the secondary winding is isolated from the primary winding.

42. A circuit for operating a fluorescent lamp from a source of DC power, the circuit comprising:

a current-mode switching regulator having an input adapted to be coupled to the source of DC power, an output, and a control terminal adapted for receiving a signal to control the current produced at the output;

an oscillator coupled to the output of the switching regulator, the oscillator producing an AC voltage;

a step-up transformer having a primary winding, and a secondary winding adapted to be coupled to the fluorescent lamp, the primary winding being coupled to the oscillator to transform the AC voltage produced by the oscillator to a high AC voltage across the secondary winding sufficient to operate the fluorescent lamp; and a current sensing circuit including an impedance adapted to conduct at least a portion of the current output by the primary winding of the transformer to generate a feedback signal proportional to that current, the current sensing circuit being coupled to conduct the feedback signal to the switching regulator to regulate the current conducted and the intensity of light emitted by the fluorescent lamp.

43. The circuit of claim 42, wherein the secondary winding is isolated from the primary winding.

44. A circuit operable from a source of DC power, the circuit comprising:

at least one fluorescent lamp;

a regulator having an input adapted to be coupled to the DC power source, an output, and a control terminal adapted for receiving a feedback signal to control the output;

a DC-to-AC inverter, coupled to the output of the regulator, for producing at an output terminal high-voltage AC sufficient to cause the fluorescent lamp to emit light, the output terminal being magnetically coupled to generate a current through the fluorescent lamp; and a sensing circuit for indirectly sensing the current conducted by the fluorescent lamp by monitoring the current passing through the inverter, for generating the feedback signal indicative of the magnitude of the lamp current, and for coupling the feedback signal to the regulator to regulate the current conducted and the intensity of light emitted by the lamp.

45. The circuit of claim 44, wherein the fluorescent lamp is isolated from the inverter.

46. A method for operating a fluorescent lamp from a source of DC power, the method comprising the steps of:

converting the DC power into AC voltage sufficient to generate a current through the fluorescent lamp to cause the fluorescent lamp to emit light, indirectly sensing the current conducted by the fluorescent lamp by monitoring one of an input current and an output current during the step of converting;

generating a feedback signal indicative of the magnitude of one of the input current and the output current; and controlling the conversion of DC power to high-voltage AC in response to the feedback signal so that the current conducted and the intensity of light emitted by the lamp are regulated.

47. The method of claim 46, wherein the step of indirectly sensing senses the input current and the output current such that the input and output currents are isolated from the lamp.

48. The method of claim 46, further including the step of adjusting the feedback signal to responsively adjust the current conducted by the fluorescent lamp, whereby the intensity of light emitted by the fluorescent lamp can be smoothly and continuously varied over a range of intensities.

49. The method of claim 46, further including the step of adjusting the feedback signal to responsively adjust the current conducted by the fluorescent lamp, whereby the intensity of light emitted by the fluorescent lamp can be smoothly and continuously varied from substantially full OFF to full ON.

50. The method of claim 46, wherein the controlling step converts the DC power into substantially sinusoidal high-voltage AC.

51. The method of claim 46, wherein the feedback signal is proportional to the current conducted by the fluorescent lamp.

* * * * *